United States Patent [19]

Barabas

[11] 4,424,079

[45] Jan. 3, 1984

[54] RUST REMOVAL PROCESS

[75] Inventor: Eugene S. Barabas, Watchung, N.J.

[73] Assignee: GAF Corporation, New York, N.Y.

[21] Appl. No.: 364,000

[22] Filed: Mar. 31, 1982

[51] Int. Cl.[3] ..... B08B 7/00

[52] U.S. Cl. ..... 134/4; 134/3; 252/82; 427/444

[58] Field of Search ..... 134/3, 4, 42; 252/82; 427/156, 309, 327, 388.1, 388.4, 444, 388.2

[56] References Cited

U.S. PATENT DOCUMENTS

| | | | |
|---|---|---|---|
| 3,696,498 | 10/1972 | Leontaritis et al. | 427/156 |
| 3,922,394 | 11/1975 | Lozier | 427/388.4 |
| 4,200,671 | 4/1980 | Krajewski et al. | 134/4 |
| 4,325,744 | 4/1982 | Panayappan et al. | 134/4 |
| 4,351,673 | 9/1982 | Lawson | 134/3 |

*Primary Examiner*—Sadie L. Childs

*Attorney, Agent, or Firm*—Joshua J. Ward; J. Gary Mohr; Marilyn J. Maueł

[57] ABSTRACT

Rust is removed from metal surfaces by applying a coating of an aqueous solution of vinylpyrrolidone/-maleic acid copolymer. The rust becomes incorporated into the coating during drying and the coating detaches itself from the metal surface for easy removal.

6 Claims, No Drawings

RUST REMOVAL PROCESS

FIELD OF THE INVENTION

The invention relates to removal of rust from metal surfaces.

BACKGROUND OF THE INVENTION

Adequate removal of rust from metal surfaces in preparation for the application of paint or other protective coatings is a long standing problem. Mechanical cleaning techniques such as sand blasting, wire brush scrubbing, etc. are messy and time consuming. Previous attempts to chemically clean rusty surfaces have not been entirely satisfactory.

One particularly difficult type of metal surface to clean is the irregular surfaces found on ships, i.e., high-temperature valves, pipes, and the like. Frequently, the only cleaning method feasible is the lengthy and tiresome process of wire brushing the surface to be cleaned and then subsequently applying a solution of a wetting agent mixed with a cleaning agent to the metal surface. Such a technique suffers from the difficulty of keeping the cleaning fluid in contact with the surface to be cleaned, such as overhead objects, as well as the subsequent disposal of liquid wastes. Additionally, these solutions are often toxic, non-economical, and require large volumes of water for washing purposes.

Previous attempts to chemically remove rust have involved the use of chemicals such as inhibited hydrochloric acid, ethylenediaminetetraacetic acid (EDTA), EDTA/citric acid, etc. More recently it has been suggested that a paste of water-soluble polymer such as polyvinylpyrrolidone (PVP) and a chelating agent such as EDTA be coated onto a rusty metal surface to be cleaned. After application the paste is said to harden into a thick crust which encapsulates the rust and may be peeled from the cleaned surface and disposed of as solid waste. This process is more fully described in pending U.S. application Ser. No. 172,348 filed July 25, 1980 now U.S. Pat. No. 4,325,744, and available from National Technical Information Service.

SUMMARY OF THE INVENTION

The invention is a process for removing rust from a rusty metal surface which comprises:

(a) applying to said rusty surface a layer of rust removal coating composition consisting essentially of an aqueous solution of a copolymer of N-vinyl-2-pyrrolidone and maleic acid and;

(b) allowing said layer of coating composition to dry whereby rust becomes incorporated into said layer and the layer containing the rust detaches itself from the surface.

DETAILED DESCRIPTION OF THE INVENTION

N-vinyl-2-pyrrolidone/maleic acid copolymer used in the invention (PVP/MA) may be formed by hydrolysis of precursor copolymer of N-vinyl-2-pyrrolidone and maleic anhydride. The N-vinyl-2-pyrrolidone/-maleic anhydride copolymer may be obtained by any of the conventional methods known for making this copolymer as exemplified for instance in U.S. Pat. No. 2,676,949, the disclosure of which is incorporated herein by reference. In practicing the invention the N-vinyl-2-pyrrolidone/maleic acid copolymer is used in the form of an aqueous solution generally containing between about 5 and about 60 weight percent (wt %) polymer and between about 40 and about 95 wt % water. The molecular weight of the N-vinyl-2-pyrrolidone/maleic acid copolymer used may vary widely. Copolymers having K values between about 20 and about 50 or even higher are for instance generally considered suitable for use in practicing the invention.

It will be appreciated that viscosities obtainable within the preferred limits of water content and K value mentioned above may vary widely, the major variable being the amount of water used. The choice of preferred viscosity for the rust removal coating compositions of the invention will depend largely upon the intended use. For instance for lightly rusted metal surfaces it may be desired to have a thin liquid coating having a viscosity for instance between about 50 and about 50,000 centipoises (cps) such that the coating can be applied with an ordinary paint brush to a thickness between about 0.01 and about 5 mm. For many applications a relatively high viscosity, paste like coating having a viscosity e.g. between about 10,000 and about 250,000 cps may be desired. Such high viscosity coatings may be easily applied even to overhead surfaces e.g. with a putty knife to form coatings of between about 0.5 and about 20 mm or thicker as desired. The paste like form of the copolymer is especially preferable for application to vertical or overhead surfaces where excessive dripping and flowing of the coating after it is applied to the rusted surface would be undesirable.

If desired the viscosity of coating composition for use in the invention may be increased by including in the composition one or more thickening agents in an amount sufficient to increase the viscosity of the composition to the desired value. For this purpose any conventional thickening agents may be used. When used, thickening agents are frequently used in amounts between about 0.1 and about 10 wt. % based on total composition. Suitable thickening agents include for instance: natural or synthetic gums such as xanthan, guar, tragacanth, etc.; cellulose derivatives such as cellulose, etc. Crosslinked interpolymers of the type described in U.S. Pat. No. 3,448,088, the disclosure of which is incorporated herein by reference, are for instance suitable for this purpose.

The precursors of the copolymers for use in the process of the invention are N-vinyl-2-pyrrolidone/maleic anhydride copolymers of the formula

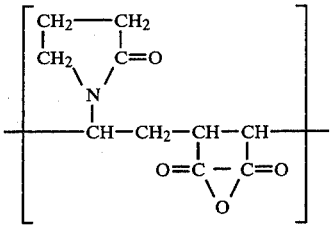

As mentioned the copolymer is used in the form of an aqueous solution. The copolymer as used has the general formula

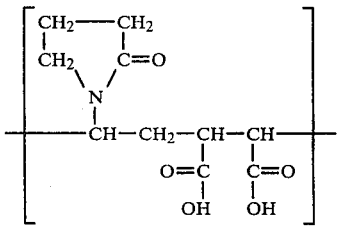

In practicing the invention it is generally preferred that the coating composition be applied to the rusty metal surface in a thickness of at least about 0.01 mm, more preferably between about 0.5 and about 2 mm. For heavily rusted surfaces it is preferred that the coating be at least about 1 mm thick to ensure suitably complete removal of rust. Coatings applied in the preferred thicknesses mentioned will, under most normal conditions, dry in periods of time between about 0.5 and about 8 hours. Drying time depends upon a number of conditions including primarily coating thickness and viscosity and atmospheric conditions, especially temperature and humidity. If coatings are allowed to dry completely the rust becomes incorporated in the coating (assuming the coating is sufficiently thick for the amount of rust on the surface of the metal) and the dried coating containing the rust becomes detached from the metal surface in the form of e.g. flakes or small strips which may remove themselves by separating from the metal surface or may be easily removed such as by brushing or blowing. In the case of overhead surfaces the self-removing feature is such that it is usually sufficient merely to allow the flakes or strips of dried coating to fall from the surface of the metal under the influence of gravity. The self-removing property of the copolymers used is relatively insensitive with respect to variations in temperature and humidity. Under some conditions, such as when the coating is not allowed to dry completely, it may be necessary to brush or scrape the surface to completely remove the rust laden coating. While the exact mechanism by which the rust is incorporated into the coating becomes detached from the metal surface is not fully understood, it is believed that the coating composition soaks into and complexes the rust with the film forming properties of the coating being such that the coating containing rust tends as it becomes completely dry to detach spontaneously from the metal surface.

The following examples are intended to illustrate the invention without limiting the scope thereof. The material identified in the examples as VAZO 52 is 2,2'-azobis-(2,4-dimethylvaleronitrile initiator available from duPont.

EXAMPLE 1

A coating composition suitable for use in practicing the invention was prepared by the following procedure:

Into a clean, dry 1 gallon autoclave (Autoclave A) were charged 2088.0 g methylene chloride, and 258.7 g maleic anhydride.

Autoclave A was purged three times with nitrogen by bringing up pressure to 25 psig and releasing to 2 psig. Then the contents of Autoclave A were stirred, until the solution was clear.

Into a dry, clean 1 gallon autoclave (Autoclave B) were charged 720.0 g of the solution in Autoclave A.

366.3 g N-vinyl-2-pyrrolidone and 4.5 g VAZO 52 initiator dissolved in 100 g methylene chloride.

Autoclave B was thoroughly purged with nitrogen and then heated to 45° C. with 80 RPM agitation. The contents of Autoclave B was then added over a 2½ hour period of time. When addition was completed, the system was stirred for an additional 2½ hours, while the temperature was allowed to rise to 48° C.

After that 0.5 g VAZO 52 dissolved in 10 g methylene chloride was added and stirring was continued for further 3 hours. After this period a sample was taken and tested for unreacted maleic anhydride with triphenyl phosphine indicator paper. The steps of adding initiator and stirring for 3 hours were repeated until the test was negative.

The polymer was then discharged through a filter and the filter-cake was washed three times with 500 ml methylene chloride.

The solid polymer was air dried for 1 hour. Then it was placed in a vacuum oven for 5 hours at 30 mm and 65° C.

The dried polymer had the following properties:

| | |
|---|---|
| K-Value: | 30.1 |
| Conversion: | 51.44% |
| Acid Number: | 524.0 |
| % Nitrogen: | 6.23% |

A solid sample of the dried polymer was added to water in such a way that it gave a 35% solution. The jar was shaken at room temperature, until the solution was clear. The Brookfield viscosity of the 35% solution of polymer was 760 centipoises (cps) and the solution had a pH of 1.8.

A 28 gauge sheet of black iron, the surface of which was covered with rust, was placed flat on a bench, and a coating of copolymer 1.27 mm thick was applied using a doctor knife. The width of the coating was 2½ inches.

The coated metal was allowed to stand overnight at about 23° C. and 45% relative humidity. Next morning, the brittle film separated completely from the metal substrate in strips about 1–2 mm wide. The surface of the metal was completely free of rust. The rust was firmly embedded in the separated film.

EXAMPLE 2

Another coating composition suitable for use in the process of the invention was prepared as follows.

Into a dry, clean 1 liter reaction kettle were charged under a blanket of nitrogen:

303.0 g dry toluene 88.2 g maleic anhydride and 124.9 g N-vinyl-2-pyrrolidone.

The system was heated to 55° C., then 84.0 g of a 2.5% solution of VAZO 52 in toluene was added. The system was stirred at 55° C. for 3 hours, then 16.8 of a 2.5% VAZO 52 solution was added. The stirring was continued for 1 more hour and a sample was taken. The sample was tested for unreacted maleic anhydride with triphenyl phosphine indicator paper. The addition of 16.8 g of VAZO 52 solution was repeated hourly 3 more times. After that the system was cooled to room temperature and discharged through a filter. The filter-cake was washed 3 times with 100 ml dry heptane.

The solid polymer was air dried for 1 hour, then it was placed in a vacuum oven for 5 hours at 30 mm and 65° C. The dried polymer had the following properties.

| | |
|---|---|
| Conversion: | 86.61% |
| K-Value: | 40.6 |
| Acid number: | 495.22 |
| Nitrogen: | 6.80% |

The solid sample was added to water in such a way that it gave a 35% solution. The jar was shaken at room temperature, until the solution was clear. The Brookfield viscosity of the 35% solution of polymer was 4450 cps and the solution had a pH of 1.8.

A 28 gauge sheet of black iron, the surface of which was covered with rust, was placed flat on a bench and was coated with a 1.27 mm thick layer a 35% water solution of the copolymer, using doctor knife. The width of the coating was 2½ inches.

The coated metal was allowed to stand overnight at about 23° C. and 40% relative humidity. Next morning, the brittle film separated completely from the metal substrate in strips about 1–2 mm wide. The surface of the metal was completely free of rust. The rust was firmly embedded in the separated film.

EXAMPLE 3

A rusty part of an automobile previously in an accident was coated with a 50% solution of the polymer described in Example 1. The temperature was about 85° C. and the relative humidity about 30%. Thirty minutes later the polymer coating separated from the metal surface and fell off to the ground.

The metal surface was clean and free of rust.

EXAMPLE 4

A sheet of hot rolled iron covered with rust was placed flat on a bench and coated with a 1.27 mm thick coating of a 35% aqueous solution of the polymer described in Example 1. The coated sheet was allowed to stand for 8 hours at a temperature of 20° C. and a relative humidity of 60%. At the end of this time the coating had dried and separated completely from the metal surface leaving the surface clean and rust free.

COMPARATIVE EXAMPLE I 28 gauge sheets of black iron covered with rust, were placed flat on a bench and were coated with 1.27 mm thick layers of the following solutions, using a 50 ml doctor blade (1) PVP K-87 (23% solids)
(2) PVP K-100 (23% solids)
(3) PVP/MA K-30 (35% solids)

The coated metal sheets were allowed to stand overnight at about 23° C. and 40% relative humidity. Next morning the polymer covered sheets were tested and the following observations were made.

(a) Sample #3-the PVP/MA treated sheet was rust free. The polymer film separated and broke up in small pieces.

(b) Samples #1 and #2 adhered to the surface tenaciously and showed no evidence of separation.

The observation was repeated daily for 5 days, but no change was noticed. After 6 days Sample #2 showed slight separation at one corner (about 1% of the total surface). The condition remained unchanged for two more weeks.

COMPARATIVE EXAMPLE II

Two 28 gauge sheets of rusty black iron were coated with the following polymers:

(1) PCP K-15 (50% solution)
(2) PVP K-15 (60% solution)
(3) PVP/MA K-30 (35% solution)

The thickness of the coatings was 1.27 mm.

The test samples were allowed to stay overnight at about 23° C. and 45% relative humidity. Next morning the observations were as follows.

(a) The coating of Sample #3-the PVP/MA coating broke up to small pieces and separated completely from the metal substrate. The rust was embedded in the separated polymer film. The surface of the metal was clean.

(b) Samples #1 and #2 formed tacky films, without any sign of separation. The samples were checked 6 days later, then 3 weeks later without noticing any change in the physical appearance of the iron sheets.

What is claimed is:

1. Process for removing rust from a rusty metal surface which comprises:

(a) applying to said rusty surface a layer of rust removal coating composition consisting essentially of an aqueous solution of a copolymer of N-vinyl-2-pyrrolidone and maleic acid; and (b) allowing said layer of coating composition to dry whereby rust becomes incorporated into said layer and the layer containing the rust detaches itself from the surface.

2. Process according to claim 1 wherein the coating composition contains between about 5 and about 60 wt % copolymer and between about 40 and about 95 wt % water.

3. Process according to claim 1 wherein the coating composition has a viscosity between about 50 and about 250,000 cps.

4. Process according to claim 2 wherein the coating composition is applied to the rusty surface in a layer between about 0.01 and about 20 mm thick.

5. Process according to claim 4 wherein the layer of applied coating composition is allowed to dry for between about 0.5 and about 8 hours.

6. Process according to claim 1 wherein:

(a) the coating composition consists essentially of between about 5 and about 60 wt % of said copolymer and between about 40 and about 95 wt % water;

(b) the coating composition is applied to the rusty surface to form a layer between about 0.01 and about 20 mm thick;

(c) The coating composition has a viscosity between about 50 and about 250,000 cps;

(d) the applied coating composition is allowed to dry for between about 0.5 and about 8 hours whereby the rust becomes incorporated into the layer of coating composition and the layer becomes detached from the metal surface.

* * * * *